United States Patent [19]

Jensen

[11] 4,234,295

[45] Nov. 18, 1980

[54] SUBSURFACE HYDRAULIC PUMP USING HIGH PRESSURE ACCUMULATOR

[76] Inventor: James B. Jensen, Rte. 2, Coffeyville, Kans. 67337

[21] Appl. No.: 8,419

[22] Filed: Feb. 1, 1979

[51] Int. Cl.[3] ..... F04B 9/10

[52] U.S. Cl. ..... 417/390; 417/403

[58] Field of Search ..... 417/390, 392, 401, 403

[56] References Cited

U.S. PATENT DOCUMENTS

| | | | |
|---|---|---|---|
| 513,556 | 1/1894 | Champ | 417/392 |
| 2,889,084 | 6/1959 | Tour | 417/401 X |
| 3,005,413 | 10/1961 | Coberly | 417/390 X |
| 3,385,216 | 5/1968 | Henderson | 417/390 X |

*Primary Examiner*—Richard E. Gluck
*Attorney, Agent, or Firm*—Head & Johnson

[57] ABSTRACT

A subsurface hydraulic pump using high pressure accumulator, which comprises a subsurface hydraulic reciprocating pump, comprising a large diameter cylinder and piston and a small diameter cylinder and piston. The cylinders are attached to each other at their open ends and the pistons are attached to each other with a single piston rod. The small cylinder is connected to the well tubing, from which the pump system is hung at the bottom of a well, with the complete pumping system emersed in well liquids. Two check valves are provided in the small cylinder, one for the entry of well fluids on the down stroke of the small piston and a second one which permits flow upwardly from the small cylinder into the tubing, on the upstroke of the small piston. A continuously driven hydraulic pump and a valve system are provided such that in one position of the valve the hydraulic pump withdraws liquid from the large cylinder and pumps it into a high-pressure accumulator, and on the reverse position of the valve, the pump accepts the high pressure liquid from the accumulator and pumps it at additional pressure into the large cylinder, forcing the large piston and small piston upwardly, lifting fluid into the tubing and up to the surface.

3 Claims, 4 Drawing Figures

SUBSURFACE HYDRAULIC PUMP USING HIGH PRESSURE ACCUMULATOR

BACKGROUND OF THE INVENTION

1. Field of the Invention

This invention lies in the field of apparatus for pumping liquids from deep boreholes, such as deep water or oil wells. More particularly, it concerns a type of deep well pump in which a continuously driven hydraulic pump in a down-hole assembly provides motive power to drive a reciprocating hydraulic pump in which one cylinder and piston provides the force to drive a second smaller cylinder and piston, to pump liquid up the tubing.

Still more particularly this invention relates to a method by which a high pressure accumulator acts as a storage of energy during one part of the pumping cycle in which liquid is not lifted from the borehole, and the accumulator applies its stored energy to aid the hydraulic pump in the other part of the pumping cycle in which liquid is lifted from the borehole.

2. Description of the Prior Art

In the prior art there are instances where hydraulic pumps have been placed in a deep borehole, hung on tubing, in which a hydraulic pump at the surface supplied pressurized liquid to the down-hole pump in order to pump well liquids up the tubing. This case is different from the situation where sucker rod pumps ae used, with surface mechanical pumping equipment in which a mechanical counterbalance can be utilized to average out the irregular pumping force required in the two-part pumping cycle, in which the sucker rods are lowered, and then lifted, carrying the pumped liquid. The hydraulic systems in the prior art have not utilized a counterbalance equivalent. This causes a highly variable pumping force requirement and necessitates a larger size of engine to drive the system, and so on. The counterbalance in this instance is provided by a high pressure hydraulic accumulator which accepts and stores energy during the part of the pumping cycle in which little energy is required from the hydraulic pump and on the next part of the cycle, delivers the stored energy to assist the hydraulic pump.

SUMMARY OF THE INVENTION

It is a primary object of this invention to provide a down-hole, deep-well hydraulic pump system in which a high pressure hydraulic accumulator is utilized to store hydraulic energy in those portions of the pumping cycle in which little energy is utilized in lifting liquid to the surface, and delivers energy to aid the hydraulic pump on those portions of the cycle in which high energy is required to lift liquids from the deep well.

These and other objects are realized and the limitations of the prior art are overcome in this invention, by providing an assembly comprising a motor driving a continuous hydraulic pump, a valve system that is movable from a first to a second position and back, a high pressure accumulator, and a reciprocating pump comprised of a large diameter cylinder and piston also closed at one end. They are co-axially attached at their open ends, with an opening through which well fluids can flow into and out of the space between the two pistons. The two pistons are attached to a common piston rod.

As fluid is pumped into the large diameter cylinder, force is applied by the pressurized liquid to the large piston. This, through the piston rod, pushes on the small piston at a higher unit pressure, and pushes accumulated well liquid on top of the small piston through a standing valve into the tubing, and up the tubing to the surface. The entire pumping system is attached to the bottom end of the tubing and is lowered into the well on the tubing, until it is at the proper depth. An electrical cable is provided on the outside of the tubing which provides power to the motor which drives the continuous hydraulic pump.

In the upward movement of the large and small pistons in which fluid is pumped up the tubing, fluid pressure from the motor-driven pump is applied to the large cylinder through the valve system. When the piston has advanced a selected distance, means are provided to mechanically switch the valve system, so that thereafter the hydraulic pump drains liquid from the large diameter cylinder, and pumps it into the high pressure accumulator. As the large piston moves downwardly, it can be arranged mechanically to throw the valve to the second position in which the hydraulic pump accepts pressurized liquid from the accumulator and pumps it at a higher pressure into the cylinder, and lifts the fluid to the surface.

Since the load on the pumping system is minimal during the portion of the pumping cycle in which the piston assembly is lowered, the energy output of the hydraulic pump is utilized to pump control liquid into the accumulator and store it there, so that during the next portion of the pumping cycle the stored energy plus the energy provided by the hydraulic pump can be utilized, in an additive way, to provide the energy needed to lift the liquid to the surface.

In an alternative manner, the operation of the valve can be to mechanically switch it to the first position on the upward movement of the large piston and to switch it downwardly to its second position by use of the hydraulic pressure of the accumulator. In still another manner, the valve can be switched hydraulically in both directions, dependent on the fluid pressure in the accumulator in one direction and in the cylinder in the other direction.

BRIEF DESCRIPTION OF DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
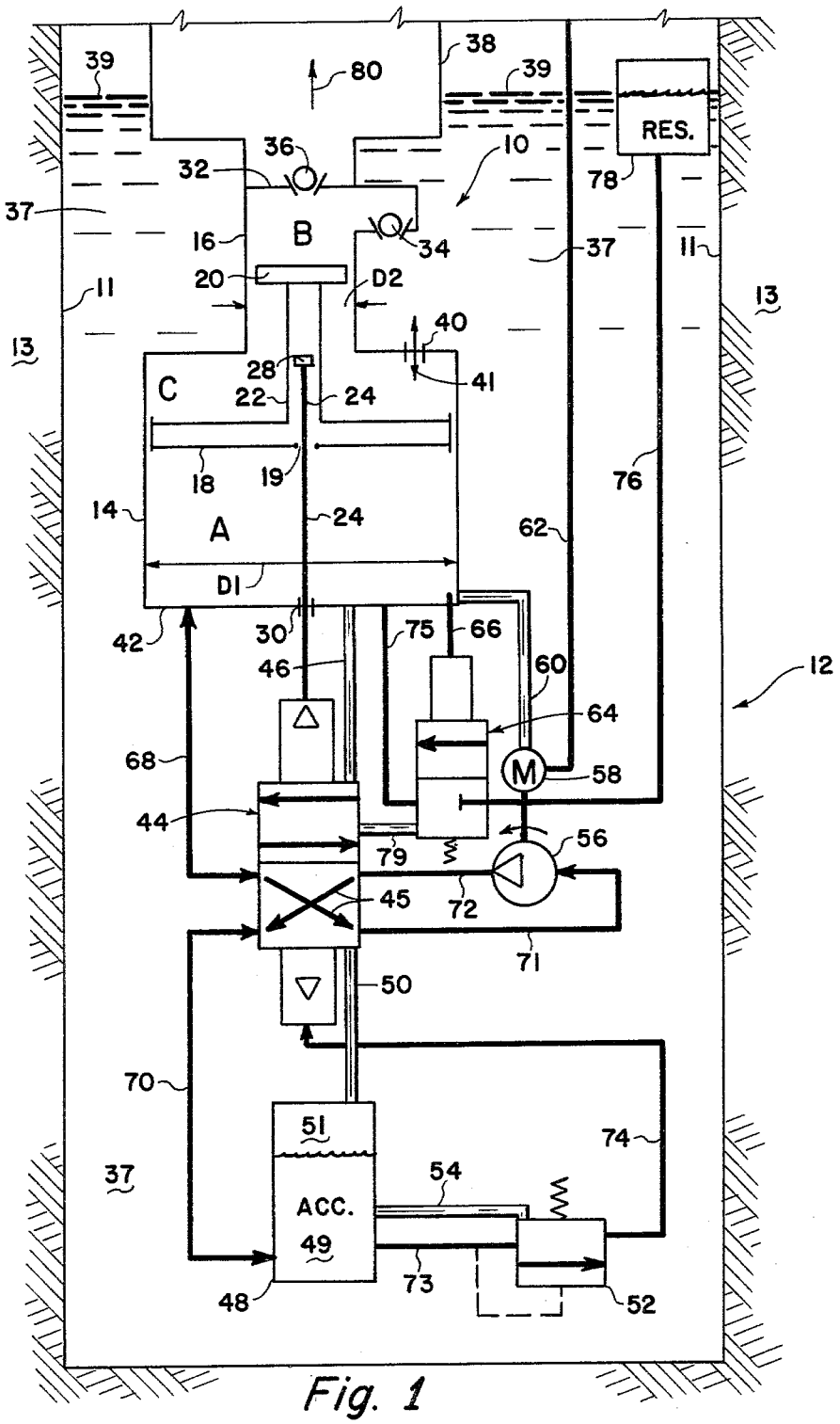
FIG. 1 is a schematic diagram of the complete subsurface pumping system.

Referring now to the drawings and in particular to FIG. 1, there is shown in schematic fashion a deep well 11 in which is inserted a down-hole pumping system which comprises two parts—a reciprocating hydraulic pump indicated generally by the numeral 10, and a motordriven hydraulic pump, valve system, and accumulator, generally indicated by the numeral 12. These provide motive power to the subsurface reciprocating pump, in order to lift well liquids to the surface.

FIG. 1 shows the bottom portion of a deep well in which the casing is indicated by the numeral 11, and is positioned in the earth 13. Such casing would be conventional. Well liquids stand inside the casing to a selected level 39, the well fluid being indicated by the numeral 37, and the earth by the numeral 13.

Numeral 38 indicates the bottom end of a string of tubing, which hangs from the top of the casing, and supports at its bottom end the reciprocating pump 10 and the motive power portion 12, attached to the bottom of the reciprocating pump 10.

The reciprocating pump 10 comprises two parts—a large diameter cylinder (LDC) 14 closed at one end 42, and containing a large diameter first piston 18, and a small diameter cylinder (SDC) 16 closed at one end 32, and containing a small diameter second piston 20. The diameter of the small piston 20 is less than the diameter of the large piston 18. The two pistons are connected by a common piston rod 22.

The small diameter cylinder has an internal space indicated by B, and there is a first check valve 34 adapted to permit entry of well fluid 37 into the space B of the small diameter piston, when the piston 20 attached to the large piston 18 moves downwardly to fill the space with the liquid. On the upstroke of the piston system 20, 18, there is a check valve 36 in the closed end 32 of the small diameter cylinder 16, through which the well liquids drawn into the space B can flow upwardly in accordance with arrow 80 into the tubing 38 and upwardly inside the tubing to the surface.

The motive power for driving the piston system to lift the oil from the position B up into the tubing 38 is supplied by high pressure hydraulic control liquid which is drawn from an accumulator 48, which holds liquid 49 in the lower portion of a sealed tank 48 and has a gas 51 in the top portion of the tank.

There is a valve system indicated generally by the numeral 44, which has a spool which is adapted to be moved upwardly and downwardly from a first position in which it is at the top, to a second position where it is at the bottom of its operating range. In the first position when the spool (as shown in FIG. 1) is up, liquid is drawn into the input of the pump 56, which is driven by motor 58, from the space A in the closed end of the large diameter cylinder, through the conduit 68, through the valve 44 in accordance with arrows 45, through the pipe 71, into the pump 56, and out of the pump through pipe 72, through the valve 44, and through the pipe 70 into the accumulator 48.

When the reciprocating piston system, comprising the large diameter piston 18, piston rod 22, and the small diameter piston 20 is moving down, the liquid inside of the tubing is substantially at rest, and the only movement of liquid is from the well through the check valve 34, into the space B of the small cylinder. In this operation there is a minimum of power required, and the excess power of the motor and pump 58, 56 serves to force liquid at high pressures into the accumulator 48 to increase the volume of the liquid 49 and decrease the volume of the gas 51, in order to store liquid at an increasingly higher pressure.

When the pressure in the accumulator 48 gets to a sufficiently high value, the pressure sensitive second valve 52, connected to the accumulator by pipe 73, bypasses some of the high pressure liquids through pipe 74 and causes the valve 44 to move downward, into its second position. In the second position the motor-driven pump 56 draws liquid from the high pressure accumulator, adds its own energy to the liquid, and forces it into the conduit 68 and into the space A of the large diameter cylinder. This lifts the piston assembly and forces well liquid from the space B through the check valve 56 and up into the tubing 38 and to the surface.

As the piston 18 moves upwardly, the head 28 on rod 24 comes in contact with the opening 19 in the piston 18. This lifts the rod 24, which lifts the valve 44 to its top or first position. The pump 56 then starts taking liquid from space A, and the piston 18 moves down again, and so on.

It is clear, therefore, that in the actual lifting half of the operating cycle the full output power of the motor-driven pump is augmented by the energy stored in the accumulator on the previous half of the pumping cycle. Thus the presence of the accumulator 48 serves to even out the irregular load requirements placed on the pumping system 58, 56, and a more nearly constant load cycle is placed upon the hydraulic pumping system.

FIG. 1 shows that the closed end 32 of the small diameter cylinder 16 is connected directly to the bottom end of the tubing 38. The large diameter cylinder 14 is connected to the small diameter cylinder 16. Also, the line 46 is meant to indicate that there is a rigid mechanical connection between the reciprocating pump structure 10 and the valve system 44, and through the means 50 the accumulator 48 is also rigidly attached to the pump structure. The line 60 shows that the motor-driven pump 58, 56 is also rigidly attached to the pump system 10 and to the tubing. Means 54 ties valve 52 and supports the accumulator 48. It will be clear that the electric motor 58 requires power, which is supplied by means of conductors 62, which are attached to the outside of the tubing, not shown, but extend up to the surface in the well-known conventional manner.

There is a third valve indicated generally by the numeral 64, which is attached to the valve 44 and subsurface pump assembly by means 79. This valve is supplied by high pressure control liquid from a reservoir 78, which may be down-hole, or which could be at the surface connected to the valve 64 by means of a pipe 76 outside of the tubing.

The purpose of the valve 64 is to maintain the space A and all the space in the pipes and conduits 68, 70, 73, 74, 71, 72, etc., the valve 44, and the accumulator 48 and pump 56, filled completely with control liquid. This control liquid can be any desired liquid but would preferably be a clean filtered hydraulic oil, such as is used for hydraulic purposes in industry. Since the control liquid, or control oil, is kept separate from the well liquids, all that is required is a little makeup of this control liquid from the reservoir through the pipe 76, through the valve 64. This is fed into the space A of the large diameter cylinder through the pipe 75, and is controlled by a mechanical valve actuator 66, which is inserted into the space A and is opened whenever the piston 18 reaches its bottom position. Thus on each operating cycle, when the piston 18 reaches bottom, it pushes down the mechanical actuator 66 and allows high pressure control liquid to flow through the pipe 76, through the valve and pipe 75, into the cylinder.

The large diameter cylinder 14 has a diameter D1 and the small diameter cylinder 16 has a diameter D2 which is smaller than the diameter D1. The purpose of the reduction in diameter is to provide for a lower pressure requirement on the control oil pump 56 and accumulator 48. However, any desired ratio between the large and small diameter piston and cylinder is possible.

Figure 2A:
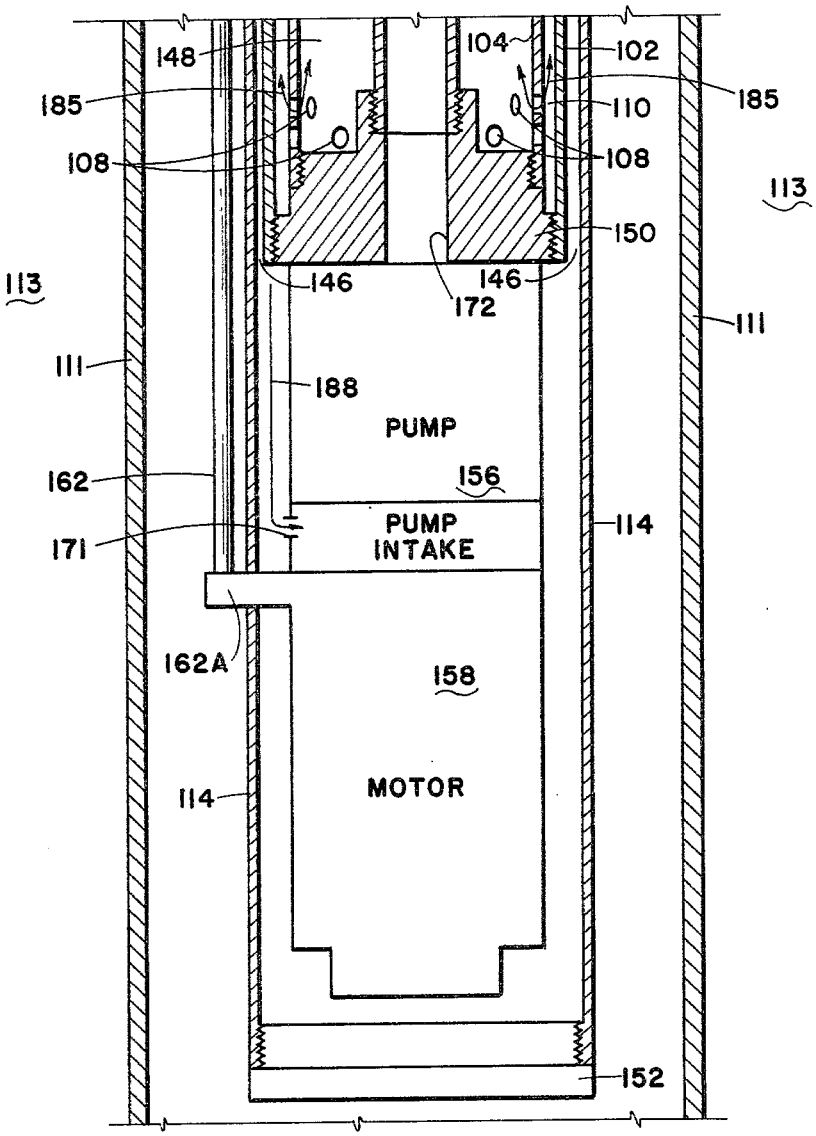
FIGS. 2A, 2B, 2C illustrate, in total, a complete diagram of the subsurface pumping unit.
Figure 2B:
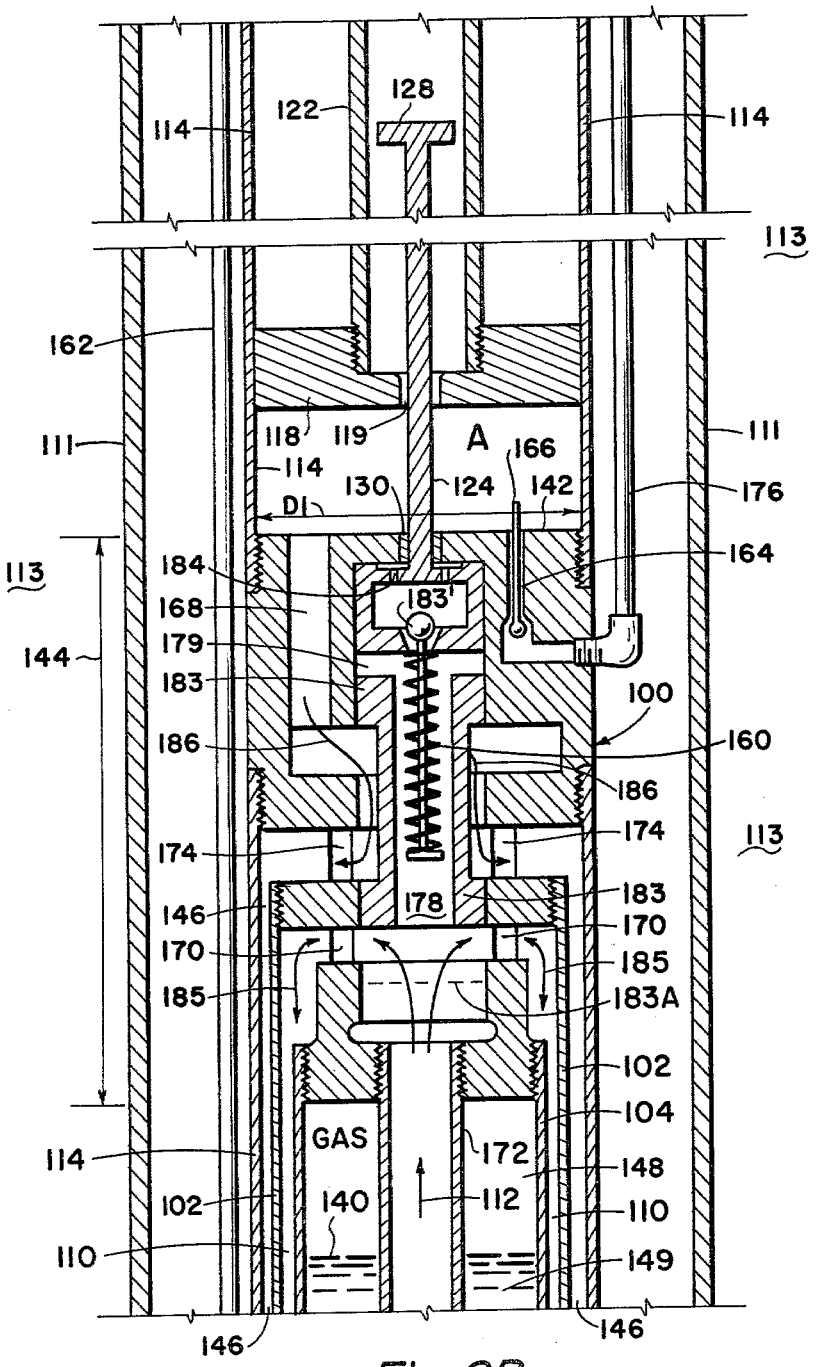
Figure 2C:
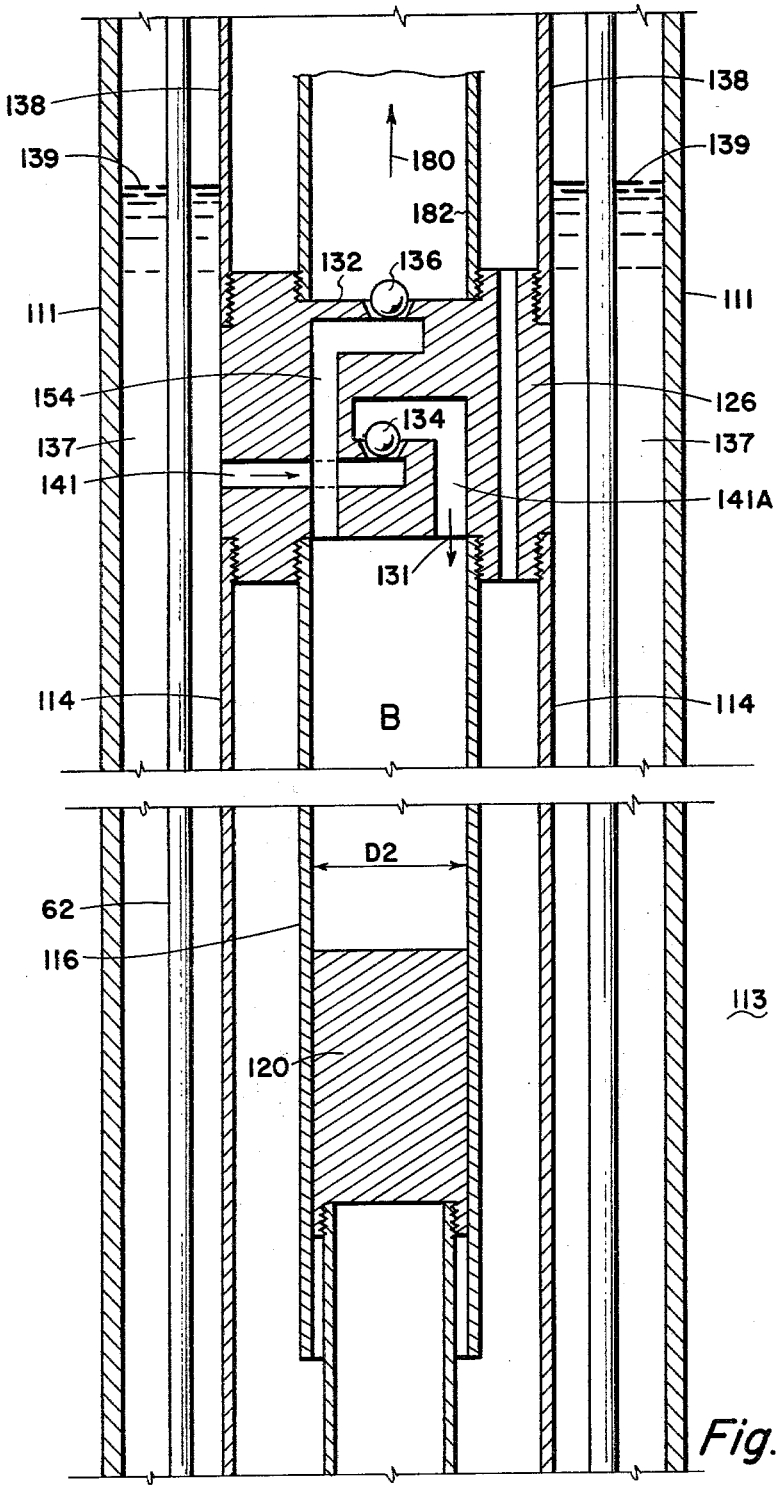

Referring now to FIGS. 2A, 2B, and 2C, there is shown one embodiment of a small diameter bottom-hole hydraulic pumping system that is designed on the basis of FIG. 1 and can be used for the pumping of liquids from the bottom of a deep well. The casing 111 in the earth 113 corresponds to the casing 11 of FIG. 1. The tubing is indicated by numeral 138 and supports the entire instrument by means of the coupling unit 126, FIG. 2C. There is a downward extending tube indicated by numeral 114, which is attached to the coupling unit 126, which supports a valve assembly indicated generally by the numeral 100, FIG. 2B. The valve assembly supports a further continuation 114, which extends below and is closed off at its bottom end 152 to provide a seal around the complete pumping unit.

In the bottom portion of the pumping unit, FIG. 2A, is an electric motor 158 which receives power through conductors 162 which are carried up to the surface outside of the tubing 114, and enter the motor through means 162A, as is well known in the art. Direct coupled to the motor 158 is a rotating hydraulic pump 156 that has an intake 171, and an axial outlet upwardly through the conduit 172, to the valve assembly 100. The pump is supported by a bottom coupling unit 150, and the stepped portion of this coupling unit supports a tube 104, which also connected to the valve assembly and encloses a space 148. There are a plurality of openings 108 in the bottom end of this cylinder 104, so that liquid can flow down through the annulus 110 between the cylinder 104 and the cylinder 102 and up through the openings in the cylinder 104, and into the space 148. The upper portion of the space 148 is occupied by gas, so that as the liquid flows upwardly in this space 148, it compresses the gas to higher pressure, and serves as a high pressure accumulator. The top of the liquid in the space 148 is indicated by the numeral 140.

There is a second annular space 146 between the cylinder 102 and the cylinder 114, which is closed off at the bottom by the closure 152 of the cylinder 114. This annular space 146 communicates with the pump intake 171 so that liquid can pass from the openings 174 into the annular space 146 and into the pump inlet 171 in accordance with arrow 188.

The cylinder 114 serves as the outer wall of the large diameter cylinder and has a diameter D1. The large diameter piston 118 slides on the inside of the cylinder 114 and has a piston rod which is the tube 122, that carries a piston 120, which is the small diameter piston, which slides inside of the small diameter cylinder 116.

Wherever possible, the numerals of the schematic diagram of FIG. 1 have been converted by adding 100 to form the numerals indicating corresponding parts in the FIGS. 2A, 2B, and 2C. This is for convenience in comparing the two drawings.

The small diameter cylinder 116 has a volume B and an internal diameter D2. The upper portion of the small diameter cylinder is closed by the coupling unit 126, which includes a pair of check valves. Check valve 134 has an inlet through opening 141 in contact with the well fluid 137. On the downward movement of the piston 120 well fluid can move inwardly through conduit 141, through the check valve 134, and through passage 141A downwardly into the space B in accordance with arrow 131. On the upward movement of the piston 120, the check valve 134 closes the conduit 141 and liquid then flows up the conduit 154 and through the check valve 136 which is inserted in the closed end 132 of the small diameter cylinder and flows upwardly in the tube 182 in accordance with arrow 180. The small tube 182 can be continued to the surface, if desired. However, tube 182 can be removed, so that the well fluid being lifted will fill the tube 138, which is the tubing string of the well. This possibility is indicated by the break in the tube 182 showing that it need not extend up the hole.

The valve system 100 is shown in cross-section and includes a spool 183, which moves from a first upward position shown in the drawing, to a downward second postion. In the first position the space A in the large diameter cylinder is connected through conduit 168, through opening 174, into the annular space 146 connecting, in accordance with arrow 188, to the pump inlet 171. This is shown in FIG. 1 also. At the same time the output of the pump 156, in accordance with arrow 112 flows upwardly through the conduit 172, through the openings 170, and in accordance with arrow 185 down the annular space 110, and into the high pressure accumulator space 148.

This down flow from the space A into the pump inlet 171 causes downward movement of the piston assembly 118, 120. At the same time, the pressure inside of the accumulator 148 is increasing. When this pressure reaches a high enough value, the check valve 183', which is held closed by the strong spring 160 is forced open and allows fluid to flow from the axial opening 178 through the openings 184 into the space above the spool 183, causing it to move downwardly into a lower second position shown by dashed line 183A. In this position the central passage 178 opens through the passages 179 into the conduit 168, so that the pump 156 is supplying high pressure liquid into the cylinder space A, lifting the piston assembly, and with it the well fluid that was drawn into the space B, up through the check valve 136, and up in the tubing 138. At the same time, the accumulator 148 is connected through annulus 110 and openings 170 and 174, into the pump intake 171. Thus the combined high pressure liquid from the accumulator 148, plus the additional pressure generated in the pump 156 provides a very high pressure liquid flowing up through the conduit 168 to lift the piston assembly 118, 120, to lift the well liquid to the surface.

When the piston 118 moves to the top of its stroke, the portion 119 strikes the upper end 128 of the spool, and lifts the spool 183 from its down or second position up to its top or first position, shown in the drawings.

Thus the upward motion of the piston to its upper limit causes the spool to move to its upper position and on the downward motion of the piston, the high pressure of the accumulator 148 causes the spool to move downward. The two portions of the pumping cycle responsive to the movement of the valve spool 183 are carried out sequentially.

The check valve 164 is held closed by high pressure liquid inside the pipe 176 until the downward movement of the piston 118 strikes the top end of the valve stem 166, and causes the check valve to open. This allows high pressure control liquid from the pipe 176, through the valve 164, into the cylinder space A. In this way makeup is accomplished for any control liquid which might be lost through leakage in packings, or in corresponding ways.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In a well having a tubing string supported from the surface, a subsurface hydraulic pump using high pressure accumulator, comprising;

(a) a subsurface hydraulic reciprocating first pump, comprising
  (1) a large diameter cylinder (LDC) open at one end and first piston;
  (2) a small diameter cylinder (SDC) open at one end and second piston;
  (3) said first and second pistons connected by a common piston rod;
  (4) said LDC and SDC connected together at their open ends, the space between said pistons open to well liquids;

(b) said hydraulic pump supported by said tubing at the bottom end thereof;

(c) an inlet check valve in the closed end of said SDC, permitting inflow of well liquid into said SDC;

(d) an outlet check valve in the closed end of said SDC, permitting outflow of liquid from said SDC into the bottom of said tubing;

(e) second pump and motor means for producing pressurized control liquid to operate said first piston in said LDC;

(f) high pressure accumulator means;

(g) first valve means operable from a first position, in which liquid is drawn from said LDC and pumped under pressure into said accumulator, thereby lowering said first and second pistons; to a second position in which liquid is pumped from said accumulator to said LDC, raising said first and second pistons; and (h) means to apply electrical power to said motor driving said second pump.

2. The appartus as in claim 1 in which said first valve means is moved from said first to said second position by the pressurized liquid in said accumulator, through pressure responsive second valve means; and is moved from said second to said first position responsive to the movement of said first piston.

3. The apparatus as in claim 1 including third valve means to replenish the supply of control liquid in said LDC and accumulator.

* * * * *